US006773326B2

(12) United States Patent
Jarvis

(10) Patent No.: US 6,773,326 B2
(45) Date of Patent: Aug. 10, 2004

(54) TOY RAZOR HAVING SIMULATED SOUND-PRODUCING CAPABILITY

(75) Inventor: Brian Marc Jarvis, Bristol, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/139,632

(22) Filed: May 7, 2002

(65) Prior Publication Data

US 2003/0211807 A1 Nov. 13, 2003

(51) Int. Cl.[7] ..... A63H 3/28; A63H 5/00; A63H 29/22

(52) U.S. Cl. ..... 446/297; 446/397; 446/484

(58) Field of Search ..... 446/297, 144, 446/319, 476, 479, 484, 472, 71, 72, 76, 397, 140, 142, 477, 485, 404, 408, 296, 298, 299, 300, 302

(56) References Cited

U.S. PATENT DOCUMENTS 3,722,136 A * 3/1973 Thorn et al. ..... 446/354
4,237,647 A 12/1980 Shaw
4,288,537 A * 9/1981 Knetzger ..... 434/169
4,334,384 A 6/1982 Rogers et al.
4,383,386 A 5/1983 Giordano et al.
4,867,726 A 9/1989 Fujimaki
5,466,181 A * 11/1995 Bennett et al. ..... 446/297
5,531,623 A * 7/1996 Garner et al. ..... 446/22
5,709,580 A * 1/1998 Stanzel ..... 446/31
6,115,477 A * 9/2000 Filo et al. ..... 381/151
6,273,782 B1 * 8/2001 Chan et al. ..... 446/356
6,290,565 B1 * 9/2001 Galyean III et al. ..... 446/99
6,443,796 B1 * 9/2002 Shackelford ..... 446/91
6,517,355 B1 * 2/2003 Long et al. ..... 434/409

* cited by examiner

*Primary Examiner*—Jacob K. Ackun
*Assistant Examiner*—Faye Francis
(74) *Attorney, Agent, or Firm*—Fish & Richardson P.C.

(57) ABSTRACT

A toy includes a base, a character figure, a simulated chair, and a simulated razor. The simulated chair is positioned on top of the base and is shaped to receive the character figure. The character figure includes simulated hair made from a deformable modeling compound. The simulated razor includes a simulated razor blade and two contacts positioned at the blade. Circuitry connected to these contacts provides a sound simulating the cutting of hair when a portion of the simulated hair provides a conductive path between the two contacts.

18 Claims, 6 Drawing Sheets

TOY RAZOR HAVING SIMULATED SOUND-PRODUCING CAPABILITY

TECHNICAL FIELD

The following description relates to a toy especially suited for young children and pertains more particularly to a battery operated toy which produces sounds resembling that of a razor or shears cutting hair.

BACKGROUND

Toys that simulate sounds to enhance realism are well known. For example, dolls and plush toys such as stuffed animals are made with sound-producing capabilities.

SUMMARY

In one general aspect, a toy includes a base, a character figure, a simulated chair, and a simulated razor. The simulated chair is positioned on top of the base and is shaped to receive the character figure. The character figure includes simulated hair made from a deformable modeling compound. The simulated razor includes a simulated razor blade and two contacts positioned at the blade. Circuitry connected to these contacts provides a sound simulating the cutting of hair when a portion of the simulated hair provides a conductive path between the two contacts.

Implementations may include one or more of the following features. For example, the base may be connected to the simulated razor by a flexible cable. The circuitry may be located in the base and connected to the contacts through the flexible cable. Alternatively, the circuitry may be located in the simulated razor.

The base may be shaped to simulate a barber shop floor. The character figure may be a hollow, cylindrical piece of solid durable material with a porous, domed cap on one end of the cylindrical piece. The simulated hair may be formed by extruding the deformable modeling compound through holes in the porous, domed cap of the cylinder.

The modeling compound may include salt to render it electrically conductive. For example, the modeling compound may contain on a weight percentage basis 30–60% wheat flour, 30–60% water, 1–5% hydrocarbon distillate, and 10–15% salt. The modeling compound may be a commercially available product known as Play-Doh® brand modeling compound.

In another general aspect, a toy includes a base and a component including contacts and connected to the base by a flexible cable. The base includes circuitry connected to the contacts through the flexible cable. The circuitry produces a sound when a conductive path is established between the contacts.

Implementations may include one or more of the features discussed above. Other features will be apparent from the description, the drawings, and the claims.

DETAILED DESCRIPTION

Figure 1:
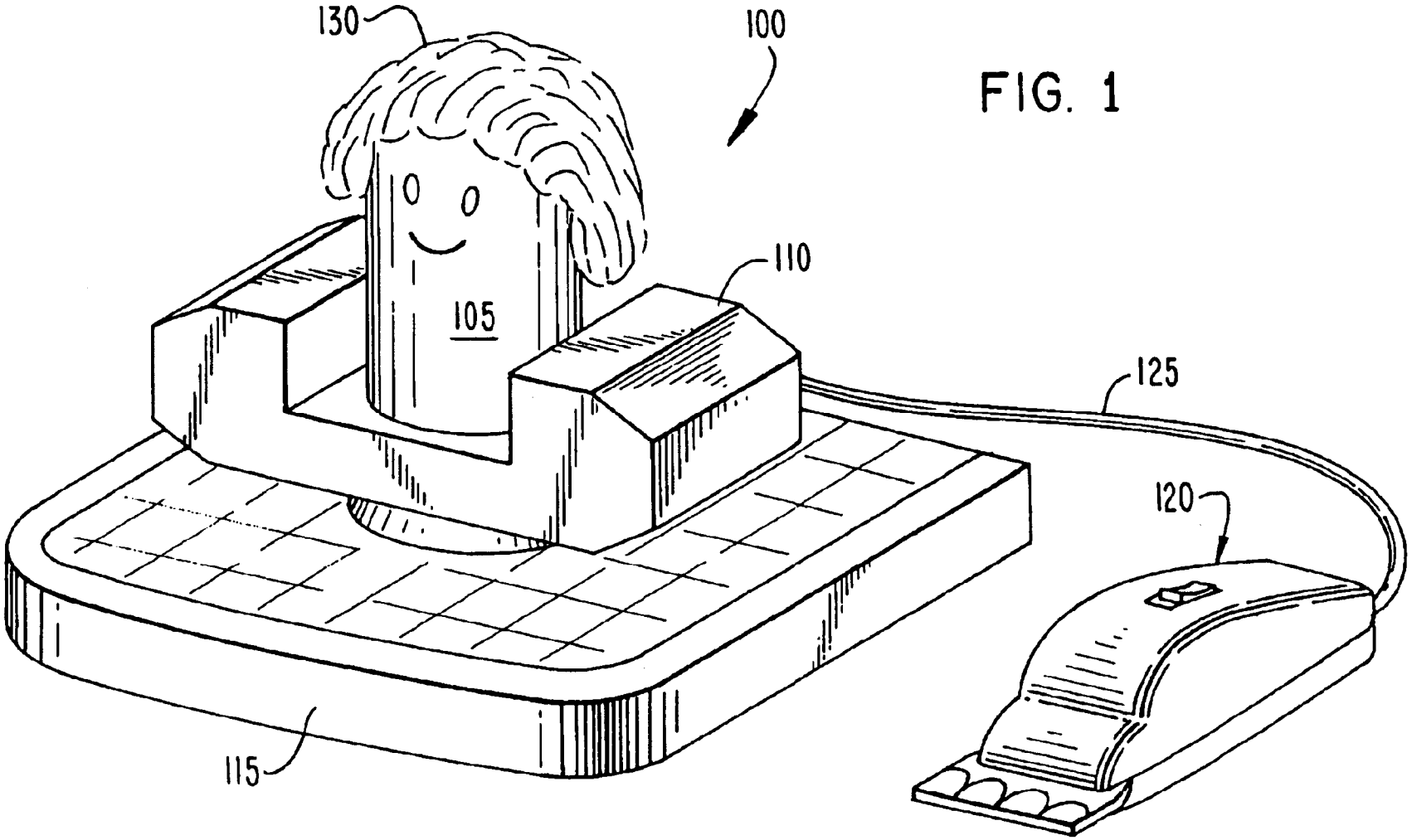
FIG. 1 is a perspective view of a simulated barber shop toy with a character figure, simulated chair, a base, and a simulated razor.
Figure 2A:
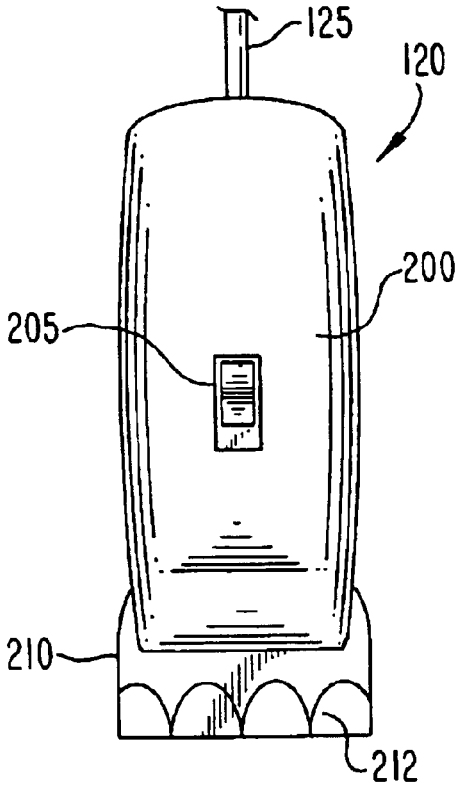
FIGS. 2A–2C are top, side, and bottom views of the simulated razor of FIG. 1.
Figure 2C:
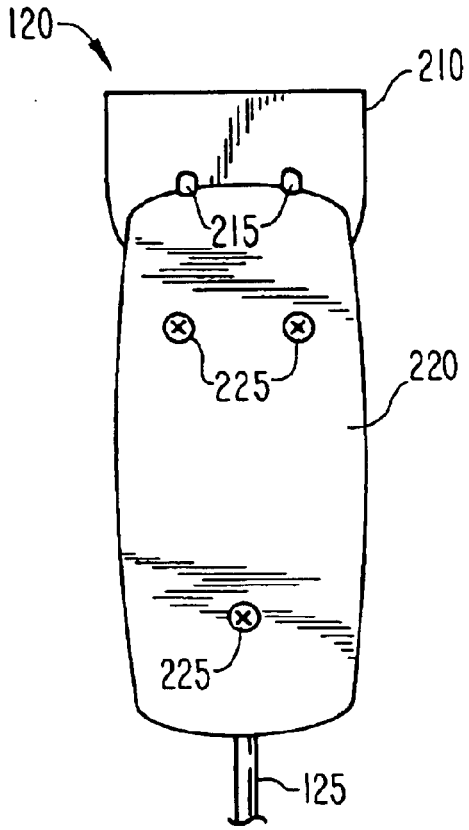
Figure 2B:
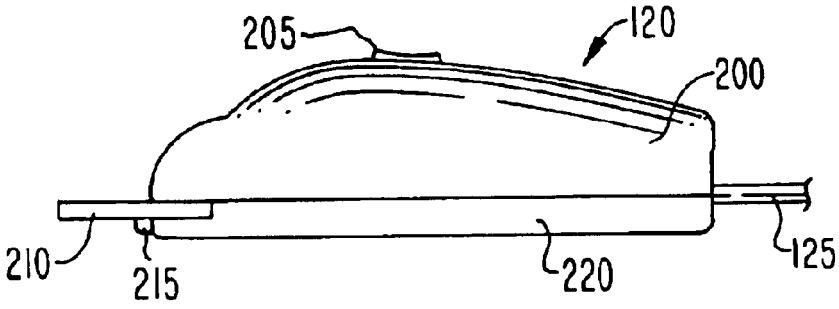
Figure 2D:
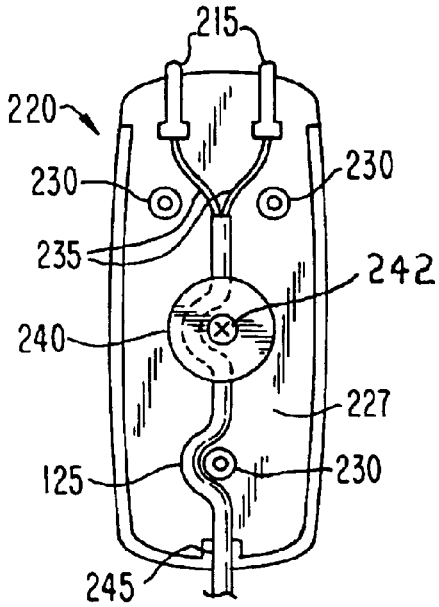
FIGS. 2D and 2E are interior views of respectively, the top and the bottom of the razor of FIG. 1.
Figure 2E:
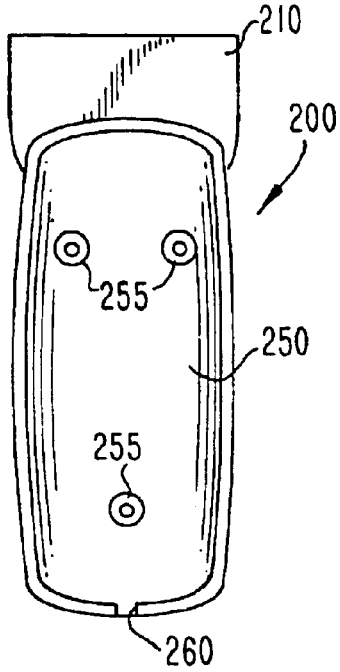

Referring to FIG. 1, a simulated barber shop 100 has a character figure 105 positioned on top of a simulated chair 110 that is located on top of a base 115. A simulated razor 120 is connected to the base 115 by a flexible cable 125. The character figure 105 has simulated hair 130 made of deformable or moldable modeling compound.

As shown in FIGS. 2A–2E, the simulated razor 120 includes a razor top 200 that includes a simulated razor power switch 205 and a simulated blade 210. The razor top 200, the simulated razor power switch 205, and the simulated blade 210 may be part of the same molded piece and may be formed of hard plastic or another hard moldable material. The simulated blade 210 includes a sticker 212 that depicts metallic cutting blades to enhance realism. Two contacts 215 are positioned beneath the simulated blade 210.

The razor top 200 is attached to a razor bottom 220 by three screws 225. The contacts 215 are attached by adhesive to the interior surface 227 of the razor bottom. The razor bottom interior surface 227 has screw holes 230 and a stress relief plate 240. The stress relief plate 240 is attached to the razor bottom interior surface 227 by a stress relief plate screw 242.

The flexible cable 125 contains two conductors 235 which are electrically and mechanically connected to contacts 215. The flexible cable 125 extends under the stress relief plate 240, around the stress relief plate screw 242, around the screw holes 230, and through a groove 245.

The interior surface 250 of the razor top includes three threaded standoffs 255 and a groove 260. The razor top 200 is connected to the razor bottom 220 by inserting the three screws 225 through the screw holes 230 and into the threaded standoffs 255. The flexible cable 125 sits in and passes through a channel defined by the groove 245 of the razor bottom interior surface and the groove 260 of the razor top interior surface.

Figure 3A:
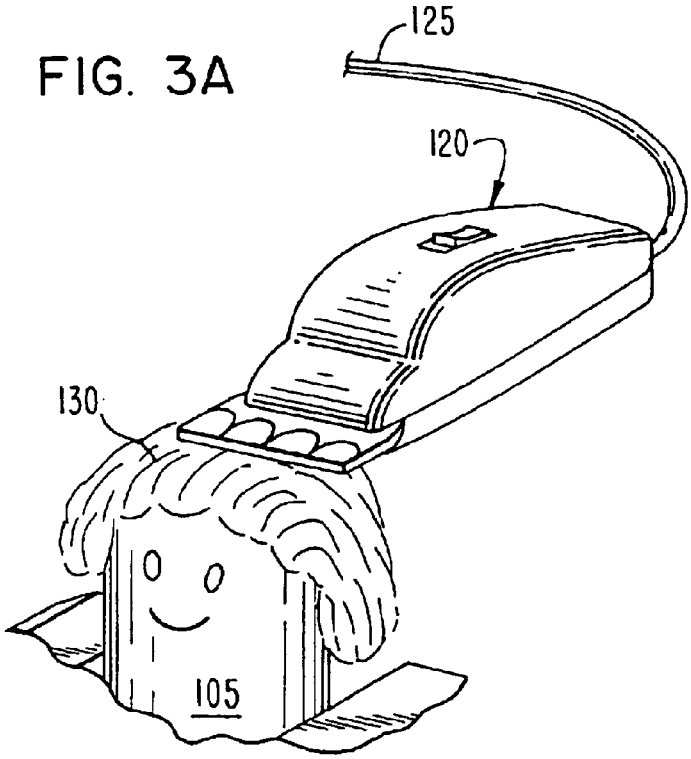
FIG. 3A is a perspective view of the simulated razor of FIG. 1 applied to the simulated hair of the character figure of FIG. 1.
Figure 3B:
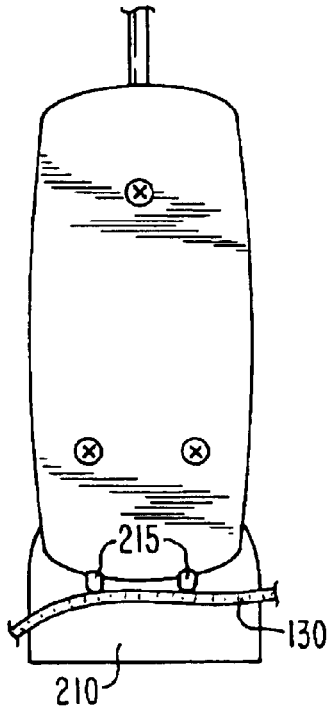
FIG. 3B is a bottom view showing a simulated hair portion providing an electrical connection between the contacts of the simulated razor.

FIGS. 3A and 3B illustrate application of the razor 120 to the simulated hair 130 of the character figure 105. A portion of the hair 130 provides an electrical connection between the contacts 215, which causes the toy to produce a simulated razor sound.

Figure 4A:
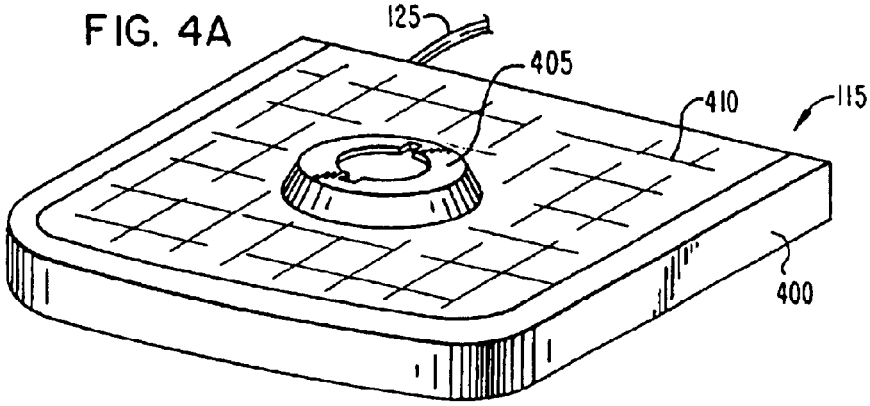
FIGS. 4A–4C are perspective, top, and bottom views of the base of FIG. 1.
Figure 4B:
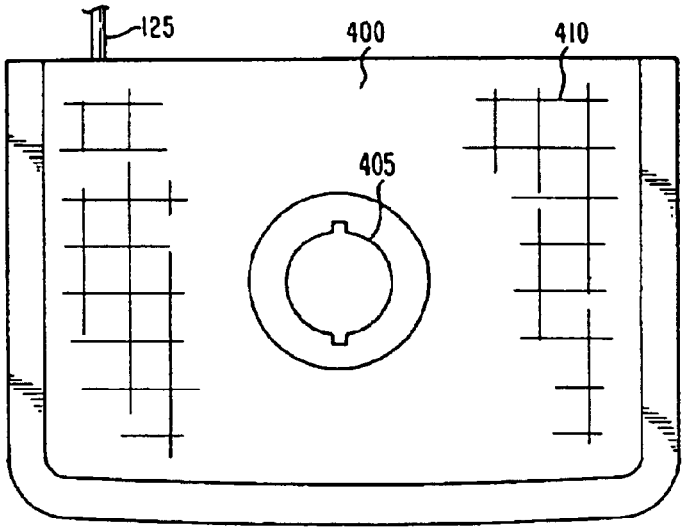
Figure 4C:
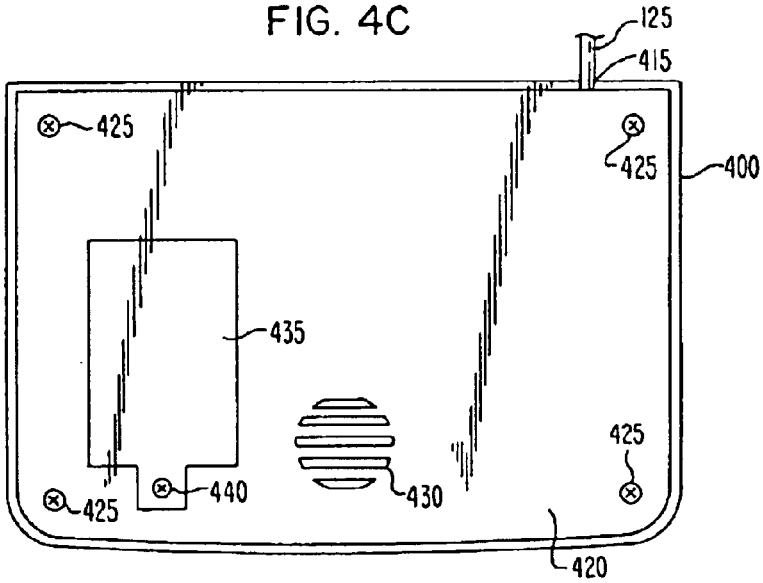

FIGS. 4A–4C illustrate the base 115 without the simulated chair or character figure attachments. The base has a base top plate 400 with a circular aperture 405 in which the chair is inserted. The base top plate also has an engraved pattern 410. The engraved pattern 410 may simulate a barber shop floor to enhance realism. The base top plate 400, circular aperture 405, and engraved pattern 410 may be part of the same molded piece and may be formed of hard plastic or another hard moldable material. The base top plate 400 has a groove 415 through which flexible cable 125 passes. A base bottom plate 420 is attached to the base top plate by four screws 425. A recessed speaker grill 430 is engraved in the base bottom plate 420. A battery container cover 435 is attached to the base bottom plate 420 by a screw 440.

Figure 5:
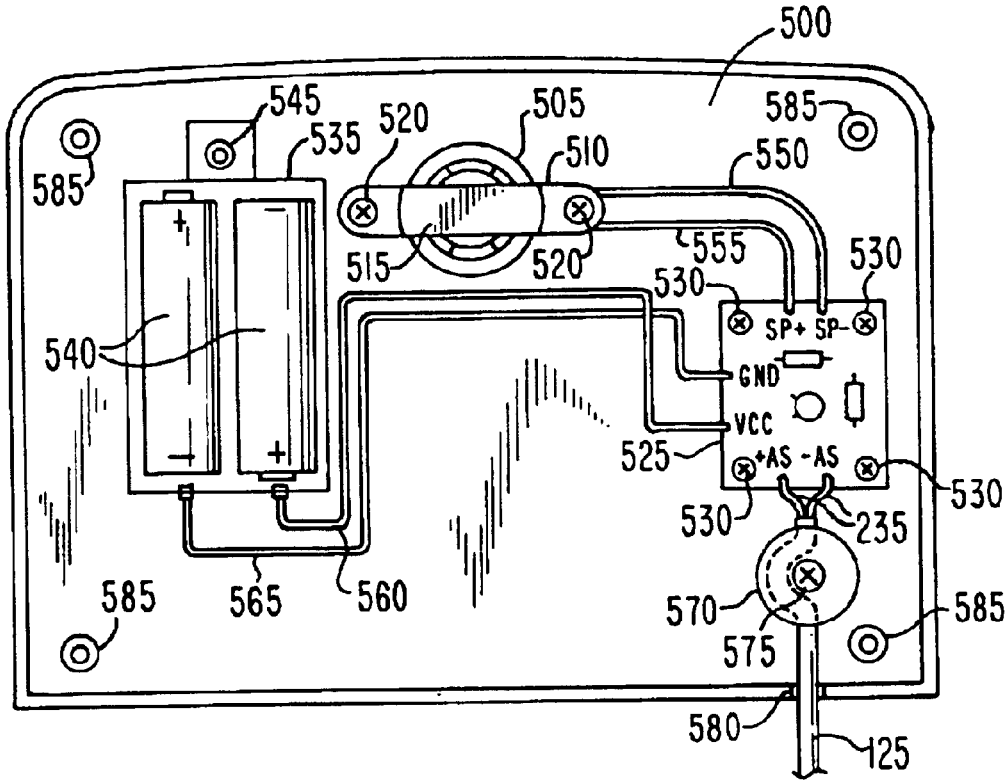
FIG. 5 is a bottom interior view of the base of FIG. 1 with attached internal components.

FIG. 5 shows the interior surface 500 of the base bottom plate 420. A speaker 505 is attached to the base bottom plate interior surface by a mounting assembly 510 that includes a mounting bracket 515 and two screws 520 which are screwed into threaded standoffs (not shown) molded into the base bottom plate interior surface 500. The speaker 505 may be a standard, small, low-power speaker. For example, the speaker may be a 27 mm diameter, 8 ohm speaker. The speaker 505 is situated adjacent to the recessed speaker grill 430 to limit muffling of the sound by the base bottom plate 420.

A circuit board 525 is attached to the base bottom plate interior surface by four screws 530 that are screwed into threaded standoffs (not shown) molded into the base bottom plate interior surface 500. The circuit board provides the electronics used to drive the speaker 505 so that the speaker "buzzes" when a portion of the simulated hair 130 provides an electrical connection between contacts 215.

A battery pack assembly 535 is also molded into the base bottom plate interior surface 500 and holds two batteries 540. In this case, the batteries are two AA batteries. A threaded cylinder 545 receives the screw 440 used to attach the battery container cover 435 to the base bottom plate 420.

The speaker 505 is electrically connected to SP+ and SP− contacts of the circuit board 525 by conductors 550 and 555, respectively. The positive and negative electrodes of the battery pack 535 are electrically connected to VCC and GND contacts of the circuit board 525 by conductors 560 and 565, respectively. A stress relief plate 570 is attached to the base bottom interior surface 500 by a stress relief plate screw 575.

The flexible cable 125 runs through a groove 550, under the stress relief plate 570, and around the stress relief plate screw 575. The two conductors 235 contained within the flexible cable 125 are electrically connected to +AS and −AS contacts of the circuit board 525.

Figure 6:
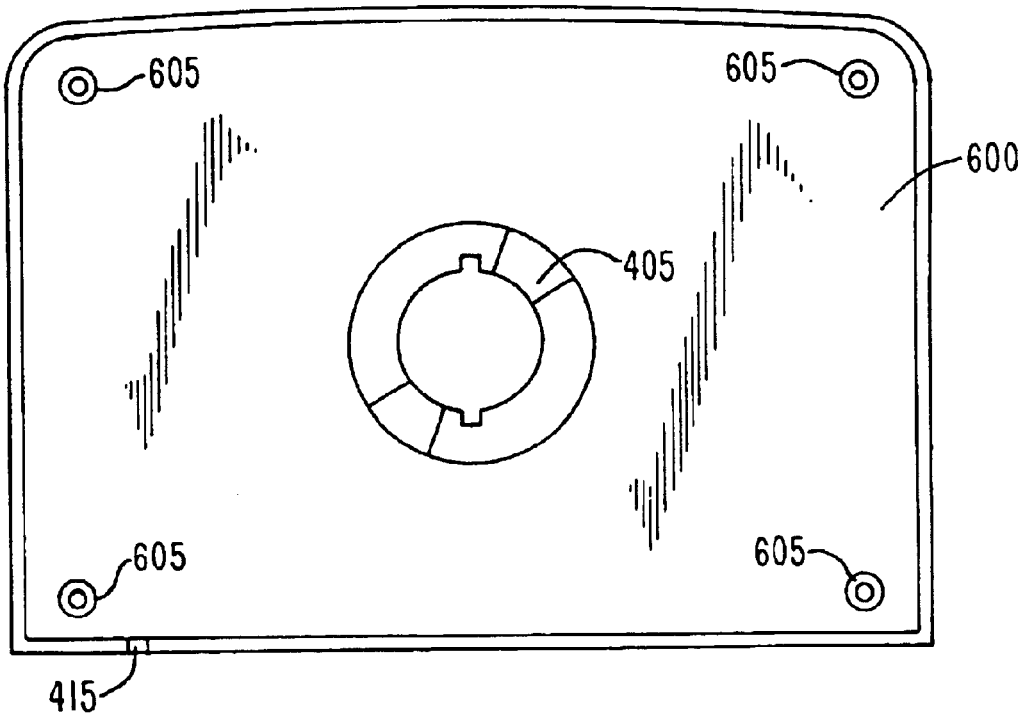
FIG. 6 is a top interior view of the base of FIG. 1.

Four hollow cylinders 585 are molded into the base bottom plate interior surface. As shown in FIG. 6, in interior surface 600 of the base top plate includes four molded, threaded standoffs 605 that mate with the cylinders 585. The four screws 425 are inserted into the hollow cylinders 585 and screwed into the standoffs 605 to secure the base bottom plate 420 to the base top plate 400.

Figure 7:
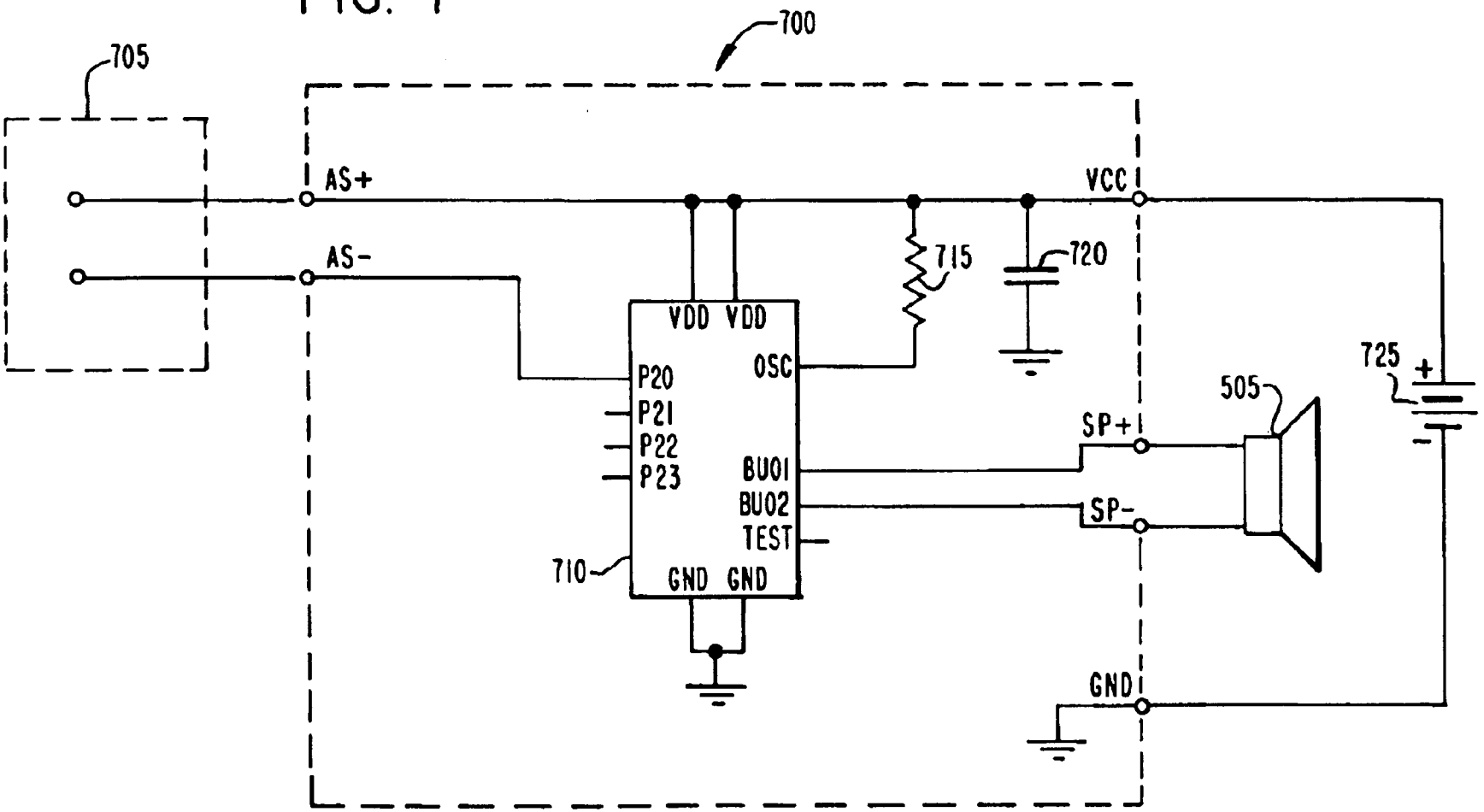
FIG. 7 is a circuit diagram of the toy of FIG. 1.

FIG. 7 shows the circuit diagram for the toy. The board circuitry 700 of the circuit board 525 and the razor circuitry 705 of the razor 120 are delineated by dashed lines. The razor circuitry 705 is simply two contacts showing an open circuit. As shown in FIG. 7, the two contacts are electrically connected to AS+ and AS− contacts of the circuit board 525.

The board circuitry 700 contains a standard one-channel voice synthesizer IC chip 710, a resistor 715, and a capacitor 720. The P20 pin of the IC chip 710 is electrically connected to one of the two contacts 215 of the razor 220. The other contact 215 of the razor is electrically connected to a voltage source 725 provided by the batteries in the battery pack assembly 535. When a portion of simulated hair 130 provides an electrical connection between the two contacts 215, the P20 pin voltage increases past a designated threshold voltage value causing a pulse wave modulation (PWM) direct drive circuit (not shown) in the IC chip 710 to generate a voltage output at the pins BUO1 and BUO2. This output drives the speaker 505 and results in a "buzzing" sound that simulates a razor or shears cutting hair. The IC chip 710 requires an external oscillation voltage component for operation. The resistor 715 and the capacitor 720 form a simple RC circuit that provides this oscillation component to the pin OSC of the IC chip 710. In one implementation, the IC chip 710 may be a SONIX SN65004 and the resistor 715 may be a 0.25W, 330K Ohm resistor may be used for the resistor 715. A standard 1 microfarad capacitor may be used for the capacitor 720.

Other implementations are within the scope of the following claims.

What is claimed is:

1. A toy comprising:

a base;

a character figure including simulated hair made from a deformable modeling compound;

a simulated chair attached to the base and shaped to receive the character figure;

a simulated razor including a simulated razor blade and two contacts positioned at the blade; and circuitry connected to the contacts and configured to provide a sound simulating the cutting of hair in response to a portion of the simulated hair providing a conductive path between the two contacts.

2. The toy of claim 1 further comprising a flexible cable connecting the base to the simulated razor.

3. The toy of claim 2 wherein the circuitry is located in the base.

4. The toy of claim 1 wherein the circuitry is located in the razor.

5. The toy of claim 1 wherein the base has an engraved pattern.

6. The toy of claim 1 wherein the character figure includes a hollow, cylindrical piece of solid durable material with a porous, domed cap covering one end of the cylindrical piece and simulated hair extruded through the porous, domed cap.

7. The toy of claim 1 wherein the modeling compound includes salt to render it electrically conductive.

8. The toy of claim 1 wherein the modeling compound contains on a weight percentage basis 30–60% wheat flour, 30–60% water, 1–5% hydrocarbon distillate, and 10–15% salt.

9. A toy comprising:

a base;

a flexible cable;

a component including contacts and connected to the base by the flexible cable; and circuitry in the base connected to the contacts through the flexible cable and configured to provide a sound in response to the provision of a conductive path between the contacts, wherein the component is a simulated razor including a simulated razor blade with the contacts positioned at the blade.

10. The toy of claim 9 further comprising simulated hair made from a deformable modeling compound that provides the conductive path between the contacts.

11. The toy of claim 10 further comprising:

a character figure including the simulated hair, and a simulated chair attached to the base and shaped to receive the character figure.

12. The toy of claim 11 wherein the character figure includes a hollow, cylindrical piece of solid durable material with a porous, domed cap covering one end of the cylindrical piece and simulated hair extruded through the porous, domed cap.

13. A toy comprising:

a base including a battery power source;

a flexible cable;

a component including contacts and connected to the base by the flexible cable; circuitry in the base connected to the contacts through the flexible cable and configured to provide a sound in response to the provision of a conductive path between the contacts; and a modeling compound that provides the conductive path between the contacts, wherein the modeling compound includes salt to render it electrically conductive.

14. The toy of claim 13 wherein the modeling compound contains on a weight percentage basis 30–60% wheat flour, 30–60% water, 1–5% hydrocarbon distillate, and 10–15% salt.

15. A toy razor comprising:

body shaped in the form of a simulated electric razor;

a simulated electric razor blade assembly connected to the body;

contacts disposed on the simulated electric razor blade assembly; and circuitry connected to the contacts and configured to provide a sound in response to the provision of a conductive path between the contacts.

16. The toy razor of claim 15, further comprising simulated hair made from a deformable modeling compound that provides the conductive path between the contacts.

17. The toy razor of claim 16, wherein the modeling compound includes salt to render it electrically conductive.

18. The toy razor of claim 16, wherein the modeling compound contains on a weight percentage basis 30–60% wheat flour, 30–60% water, 1–5% hydrocarbon distillate, and 10–15% salt.

* * * * *